US006517595B2

(12) United States Patent
Kino et al.

(10) Patent No.: US 6,517,595 B2
(45) Date of Patent: Feb. 11, 2003

(54) INTAKE DUCT AND METHOD OF PRODUCING THE SAME

(75) Inventors: Hitoshi Kino, Nishikasugai-gun (JP); Hidetoshi Ishihara, Nishikasugai-gun (JP); Takahiro Komori, Nishikasugai-gun (JP); Yoshikazu Hirose, Nishikasugai-gun (JP); Katsumi Yokohashi, Nagoya (JP); Yoshikazu Tanaka, Nisshin (JP)

(73) Assignees: Toyoda Gosei Co., Ltd., Aichi-ken (JP); Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/760,735

(22) Filed: Jan. 17, 2001

(65) Prior Publication Data

US 2001/0011448 A1 Aug. 9, 2001

(30) Foreign Application Priority Data

Jan. 17, 2000 (JP) ..... 2000-007959

(51) Int. Cl.[7] ..... F02M 35/12

(52) U.S. Cl. ..... 55/385.3; 55/486; 55/487; 123/198 E; 156/69; 156/294; 156/304.2; 156/304.6; 156/499

(58) Field of Search ..... 55/385.3, 486, 55/487; 123/198 E, 216, 439, 536, 539; 204/156, 164; 422/186.03, 186.04, 186.07, 186.13, 186.18, 186.22, 186.26; 156/258, 309.6, 349, 513, 514, 499, 69, 304.2, 304.6

(56) References Cited

U.S. PATENT DOCUMENTS 5,275,636 A * 1/1994 Dudley et al. ..... 55/385.3
5,487,874 A * 1/1996 Gibboney, Jr. ..... 123/539
5,571,242 A * 11/1996 Demorest ..... 123/198 E
5,762,858 A 6/1998 Maeda et al.
5,806,480 A 9/1998 Maeda et al.
5,914,415 A * 6/1999 Tago ..... 55/385.4
5,947,082 A 9/1999 Choi et al.
6,171,369 B1 * 1/2001 Schultink et al. ..... 55/486
6,183,536 B1 * 2/2001 Schultink et al. ..... 55/486
6,214,093 B1 * 4/2001 Nabata et al. ..... 55/486

FOREIGN PATENT DOCUMENTS

| | | |
|---|---|---|
| JP | 63-285257 | 11/1988 |
| JP | 01253559 | 10/1989 |
| JP | 5-15568 | 4/1993 |
| JP | 5-126002 | 5/1993 |
| JP | 08207164 | 8/1996 |
| JP | 11343938 | 12/1999 |
| JP | 2001012324 | 1/2001 |

* cited by examiner

*Primary Examiner*—David A. Simmons
*Assistant Examiner*—Minh-Chau T. Pham
(74) *Attorney, Agent, or Firm*—Law Offices of David G. Posz

(57) ABSTRACT

An intake duct for introducing outside air into an air cleaner of an internal combustion engine is provided which includes a hollow duct body with an opening, and a piece of non-woven fabric, formed in a flat shape, is joined to the duct body to close the opening. The duct body includes a circumferential wall formed of a resin, and the opening is formed along a plane extending through a portion of the circumferential wall. The piece of non-woven fabric is fixed to the duct body so that some of the resin of the duct body penetrates into the non-woven fabric.

9 Claims, 7 Drawing Sheets

INTAKE DUCT AND METHOD OF PRODUCING THE SAME

INCORPORATION BY REFERENCE

The disclosure of Japanese Patent Application No. 2000-7959 filed on Jan. 17, 2000 including the specification, drawings and abstract is incorporated herein by reference in its entirety.

BACKGROUND OF THE INVENTION

1. Field of the Invention

The invention relates to an intake duct for introducing outside air into an air cleaner of an internal combustion engine, for example, a vehicle engine.

2. Discussion of Related Art

An intake duct of this type normally has a hollow cylindrical shape, and the outside air admitted into an air cleaner through the duct generates intake noise such as air-column resonance. In order to reduce such intake noise, an intake duct disclosed in, for example. Japanese Application Laid-Open No. SHO 63-285257 uses an air-permeable porous material to form a part of a circumferential wall of a duct body.

As shown in FIG. 6, in the aforementioned intake duct 51, an intake port 53 for admitting the outside air is formed at one end of a duct body 52. Moreover, a connection port 54 connected to an air cleaner (not shown) through a hose (not shown) or the like is formed at the other end of the duct body 52.

A circumferential wall 55 between the intake port 53 and the connection port 54 of the duct body 52 provides a curved surface over the entire circumference thereof. An opening 56 is formed in the circumferential wall 55, and a porous material 57 is bonded to cover the opening 56. The porous material 57 is formed in a shape matching the shape of the circumferential wall 55 of the duct body 52. For example, a non-woven fabric article to which a desired shape is given by press molding is used as the porous material 57. The non-woven fabric article may be formed from synthetic resin fibers that are pressed without being woven.

By forming a part of the circumferential wall 55 of the duct body 52 from the air-permeable porous material 57, the balance between the amount of outside air admitted through the intake port 53 and the amount of outside air admitted through the porous material 57 can be adjusted. As a result, a natural frequency of the intake duct 51 is varied such that air-columnar resonance in a range of normal use of the vehicle engine is suppressed, and the intake noise is reduced.

Thus, the intake noise can be effectively reduced by using the porous material 57 to form a part of the circumferential wall 55 of the duct body 52. In the above-described conventional structure, however, the porous material 57 forming a part of the circumferential wall 55 of the duct body 52 needs to be formed or shaped in accordance with the shape of the circumferential wall 55 of the duct body 52. Thus, the production of the conventional intake duct 51 requires the step of forming the porous material 57 to match the shape of the circumferential wall 55, using molds having complicated structures for forming the porous material 57 as well as the duct body 52. Moreover, respective molds for the porous material 57 and the duct body 52 need be prepared for each intake duct 51 to be produced. Thus, the intake duct 51 of the conventional structure may suffer from undesirably high manufacturing cost.

Moreover, a gap or clearance between the porous material 57 and the circumferential wall 55 of the duct body 52 may allow the outside air to be admitted into the duct body 52. If such a gap is formed, the amount of outside air admitted through the porous material 57 and the amount of outside air introduced without passing through the porous material 57 is unbalanced, thereby possibly making it difficult to suppress the aircolumnar resonance in the range of normal use of the vehicle engine. Therefore, it is required to accurately bond the porous material 57 to the duct body 52, or to bond the porous material 57 to the duct body 52 via a separate sealing material (not shown), which may result in a significant increase in the manufacturing cost of the intake duct 51.

SUMMARY OF THE INVENTION

It is an object of the invention to provide an intake duct in which intake noise can be effectively reduced and which can be produced at a relatively low cost, and to provide a method of producing such an intake duct.

To accomplish the object and other objects, there is provided according to the first aspect of the invention an intake duct adapted to introduce outside air into an air cleaner of an internal combustion engine, which comprises: a hollow duct body including a circumferential wall formed of a resin, with the duct body having an opening formed in a portion of the circumferential wall to provide an end face that lies in a substantially flat plane. A piece of non-woven fabric is joined to the duct body so as to cover the opening. Further, the piece of non-woven fabric is fixed to the duct body by having some of the resin of the duct body penetrate into and solidify with the non-woven fabric.

In the intake duct constructed as described above according to the invention, the opening of the duct body is formed in a flat plane, and the piece of non-woven fabric is simply formed in a flat shape. This eliminates a need to form the piece of non-woven fabric into a curved profile, or the like, corresponding to the shape of the circumferential wall of the duct body. This leads to a greatly simplified structure of a mold for forming the piece of non-woven fabric, and also eliminates a need to prepare a mold for the non-woven fabric for each type of intake duct. Accordingly, the manufacturing cost of the intake duct can be significantly reduced.

The piece of non-woven fabric is joined and fixed to the duct body by having some of the resin of the duct body penetrate into the interior of the article. This arrangement makes it possible to prevent a gap or clearance from being formed between the circumferential wall of the duct body and the non-woven fabric, without requiring accurate formation of the non-woven fabric or providing a sealing material between the duct body and the non-woven fabric. Accordingly, in the intake duct, a suitable balance between the amount of outside air admitted through the non-woven fabric and the amount of outside air admitted without passing through the non-woven fabric is favorably maintained, and intake noise can be effectively reduced during normal operation of the engine. Furthermore, since accurate formation of the non-woven fabric and the sealing material are not needed, the manufacturing cost of the intake duct can be further reduced.

DETAILED DESCRIPTION OF PREFERRED EMBODIMENTS

Referring to FIG. 1 to FIG. 5, one embodiment of the invention in the form of an intake duct for a vehicle engine and a method of producing the intake duct will be now described in detail.

Figure 1:
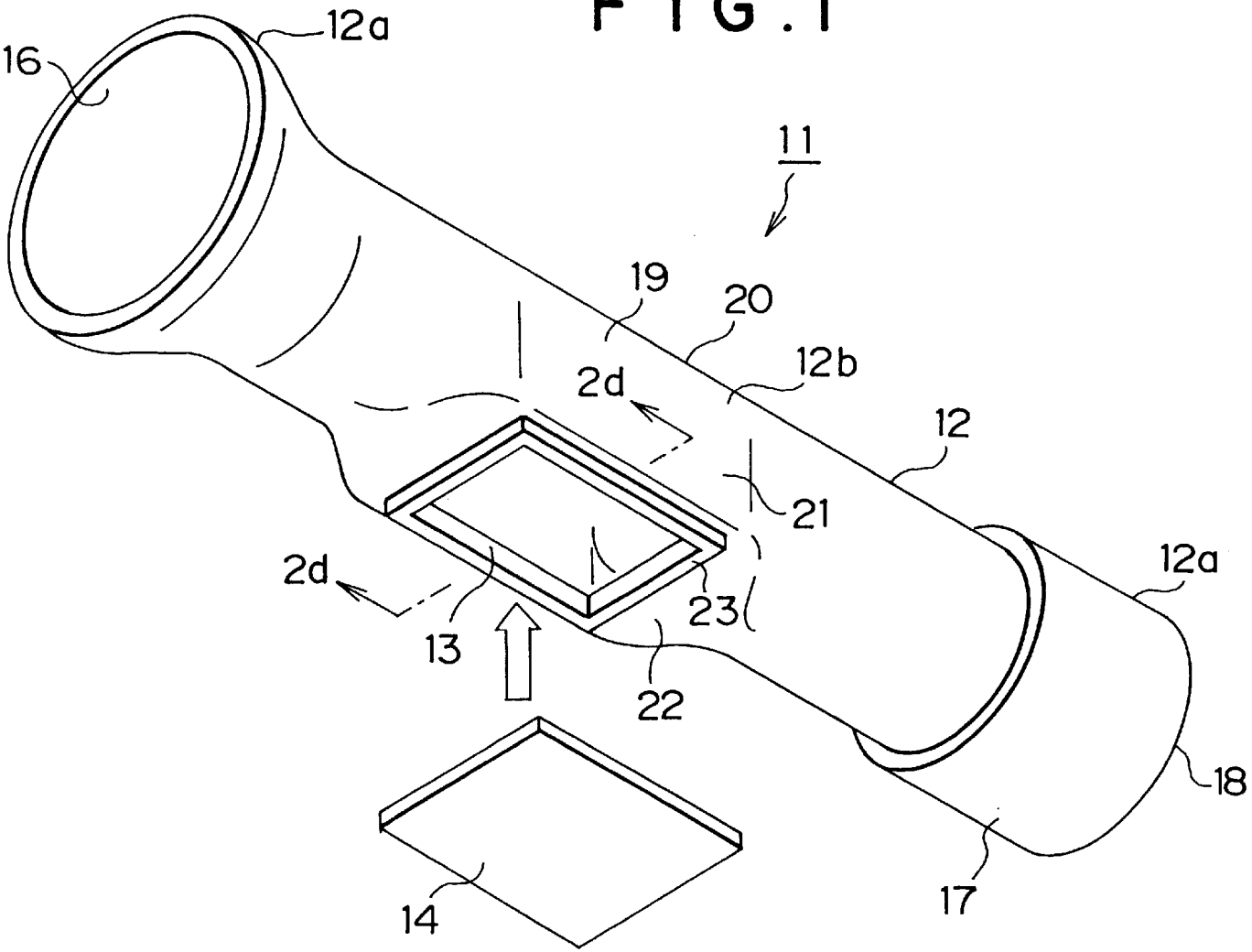
FIG. 1 is an exploded perspective view showing an intake duct according to one embodiment of the invention.

As shown in FIG. 1, an intake duct 11 is provided as a conduit for introducing the outside air into an air cleaner (not shown) within an engine compartment of a vehicle. The intake duct 11 includes a duct body 12, formed with a substantially hollow cylindrical shape, and a non-woven fabric closure 14 is fixedly bonded to cover an opening 13 formed in the duct body 12.

The duct body 12 is formed by blow molding from, for example, a thermoplastic resin such as polypropylene (PP), polyethylene (PE), polyamide (PA), polyester (for example, polyethylene terephthalate (PET)) or polystyrene (PS). An intake port 16 for introducing the outside air is formed at one end of the duct body 12. On the other hand, a fastening portion 17, to be attached to an air cleaner (not shown) via a hose (not shown) and a connection port 18, is formed at the other end of; the duct body 12. Each of the axially opposite end portions 12*a* of the duct body 12 is formed with a cylindrical shape.

Figure 2A:
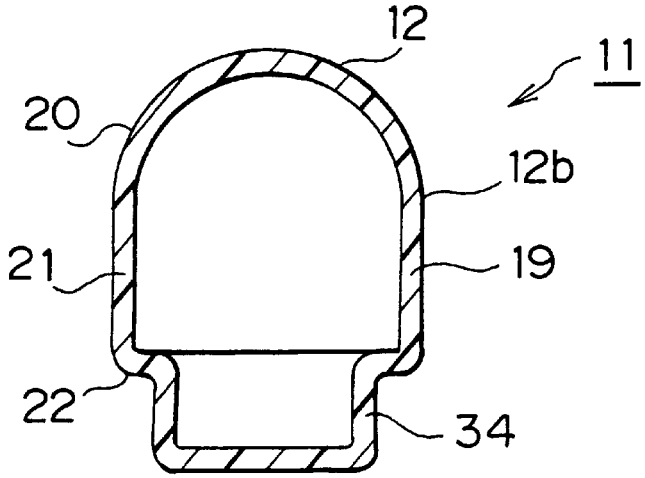
FIGS. 2A to 2E are diagrams illustrating a method of producing the intake duct shown in FIG. 1.
Figure 2B:
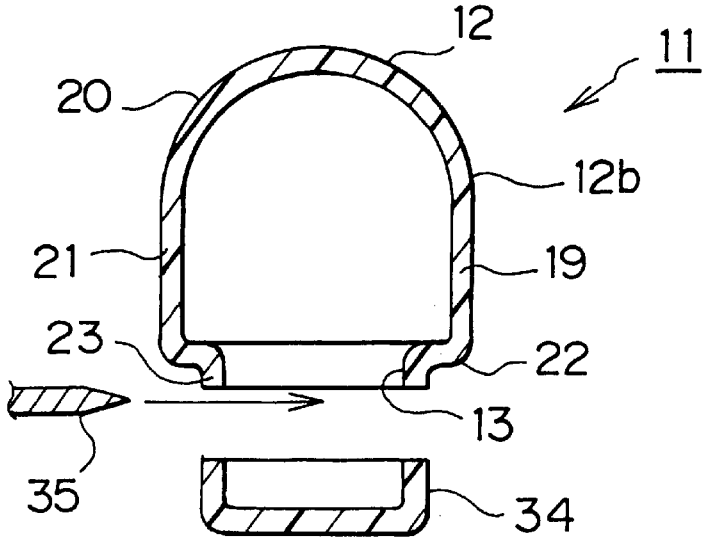
Figure 2C:
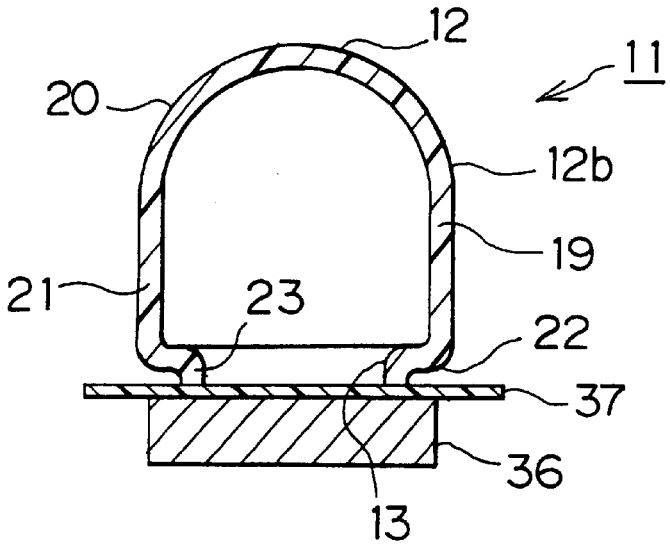
Figure 2D:
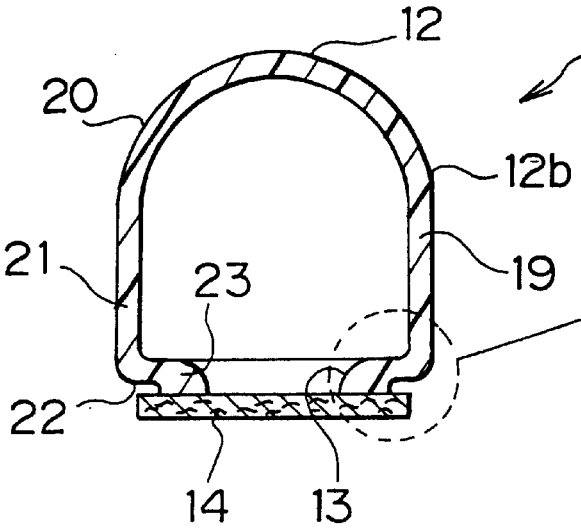
Figure 2E:
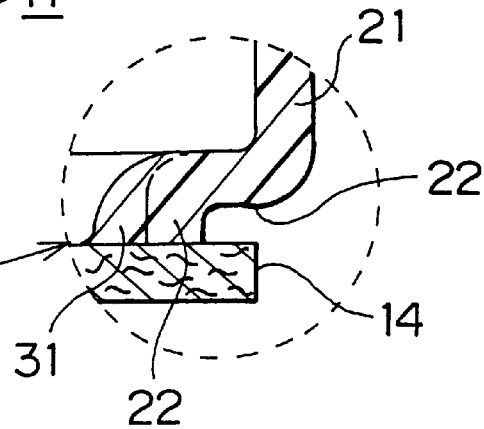

As shown in FIGS. 1, 2D and an enlarged view 2E, an axially middle portion 12*b* of the duct body 12 is shaped such that a semi-cylindrical portion 20 and a rectangular portion 21 are connected together to form a circumferential wall 19. The duct body 12 is formed to achieve smooth transition of its cross-sectional shape between the middle portion 12*b* and the axial end portions 12*a*.

The opening 13 has a rectangular shape and is formed in a flat portion 22 of the rectangular portion 21 located opposite to the semi-cylindrical portion 20 of the middle portion 12*b* of the duct body 12. A peripheral edge 23 of the opening 13, formed so as to project by a suitable height outwardly from the flat portion 22, surrounds the opening 13. The peripheral edge 23 is also formed such that the distal end face of the edge 23 lies substantially in the same plane over the entire periphery of opening 13.

Figure 3A:
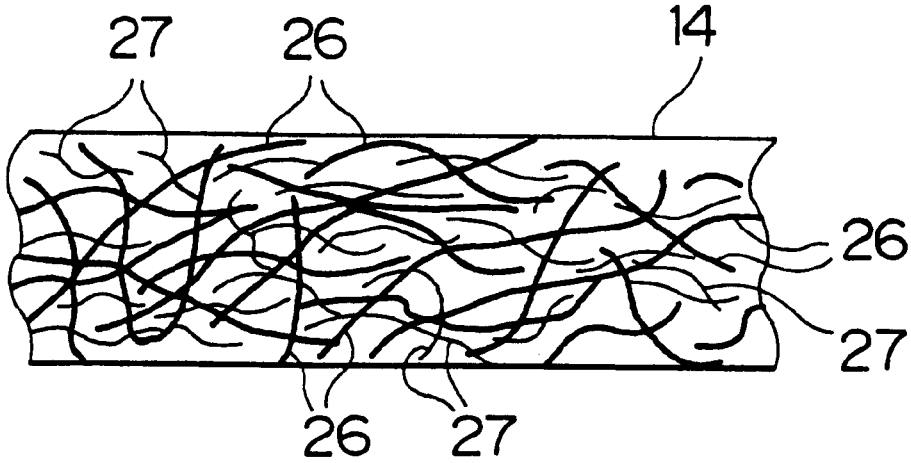
FIGS. 3A and 3B are schematic diagrams showing fibers of a non-woven fabric article of FIG. 1 which are in an entwined state.
Figure 3B:
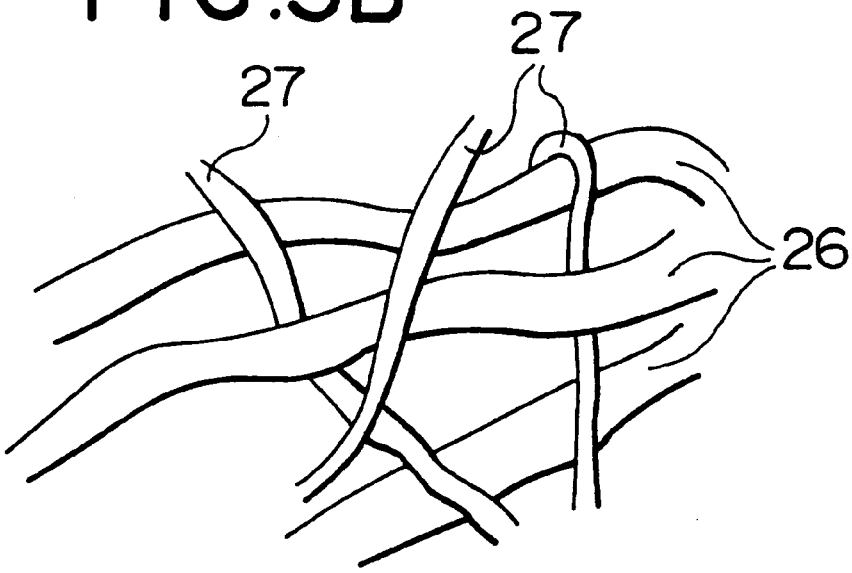
Figure 4A:
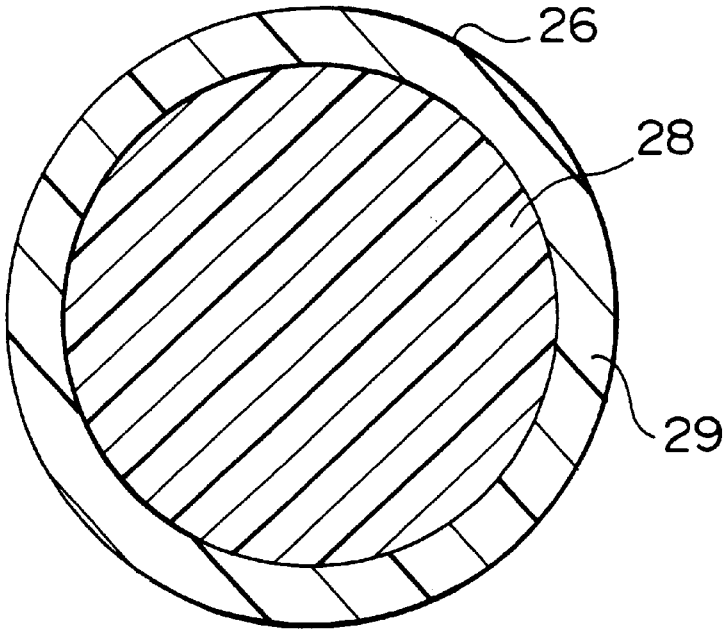
FIG. 4A is an enlarged cross-sectional view showing a binder fiber forming the non-woven fabric article of FIG. 1.
Figure 4B:
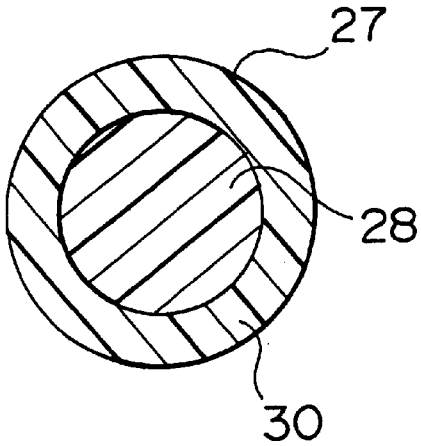
FIG. 4B is an enlarged cross-sectional view showing a regular fiber forming the non-woven fabric article of FIG. 1.
Figure 5:
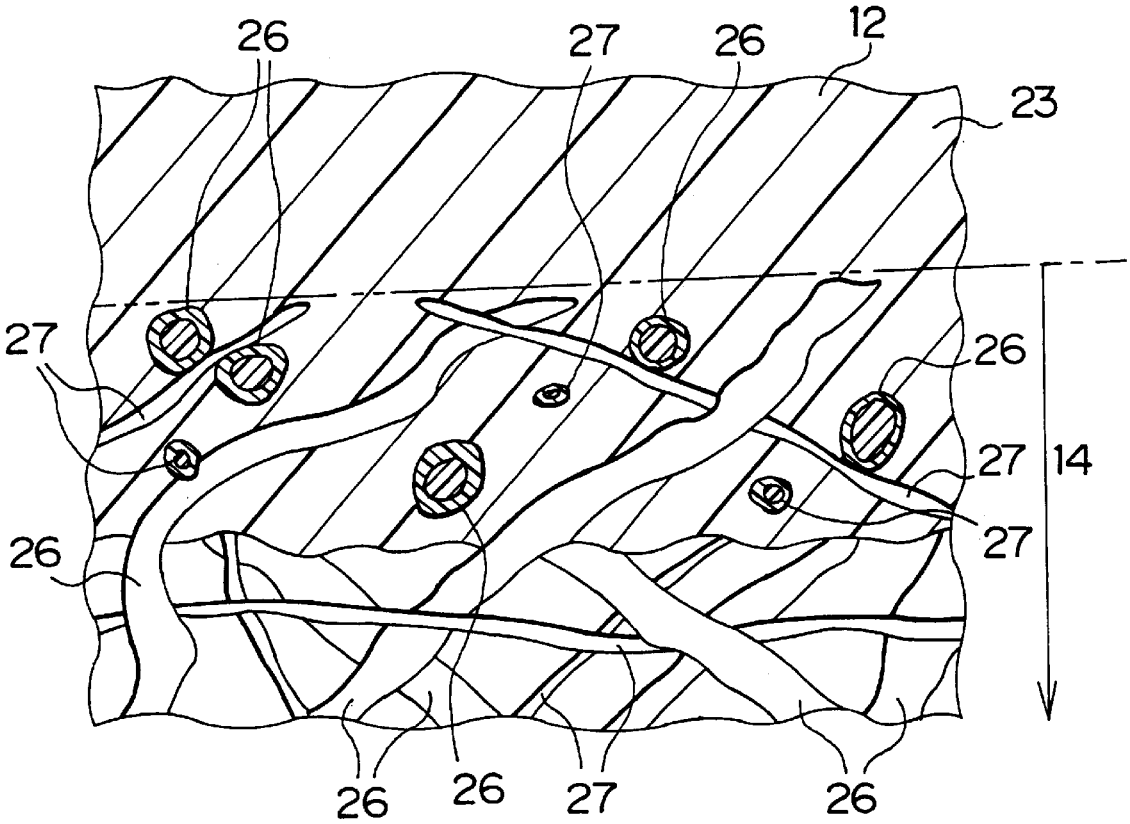
FIG. 5 is a partial cross-sectional view showing the state in which a part of resin of a peripheral edge of an opening of FIG. 1 penetrates into the non-woven fabric article.
Figure 6:
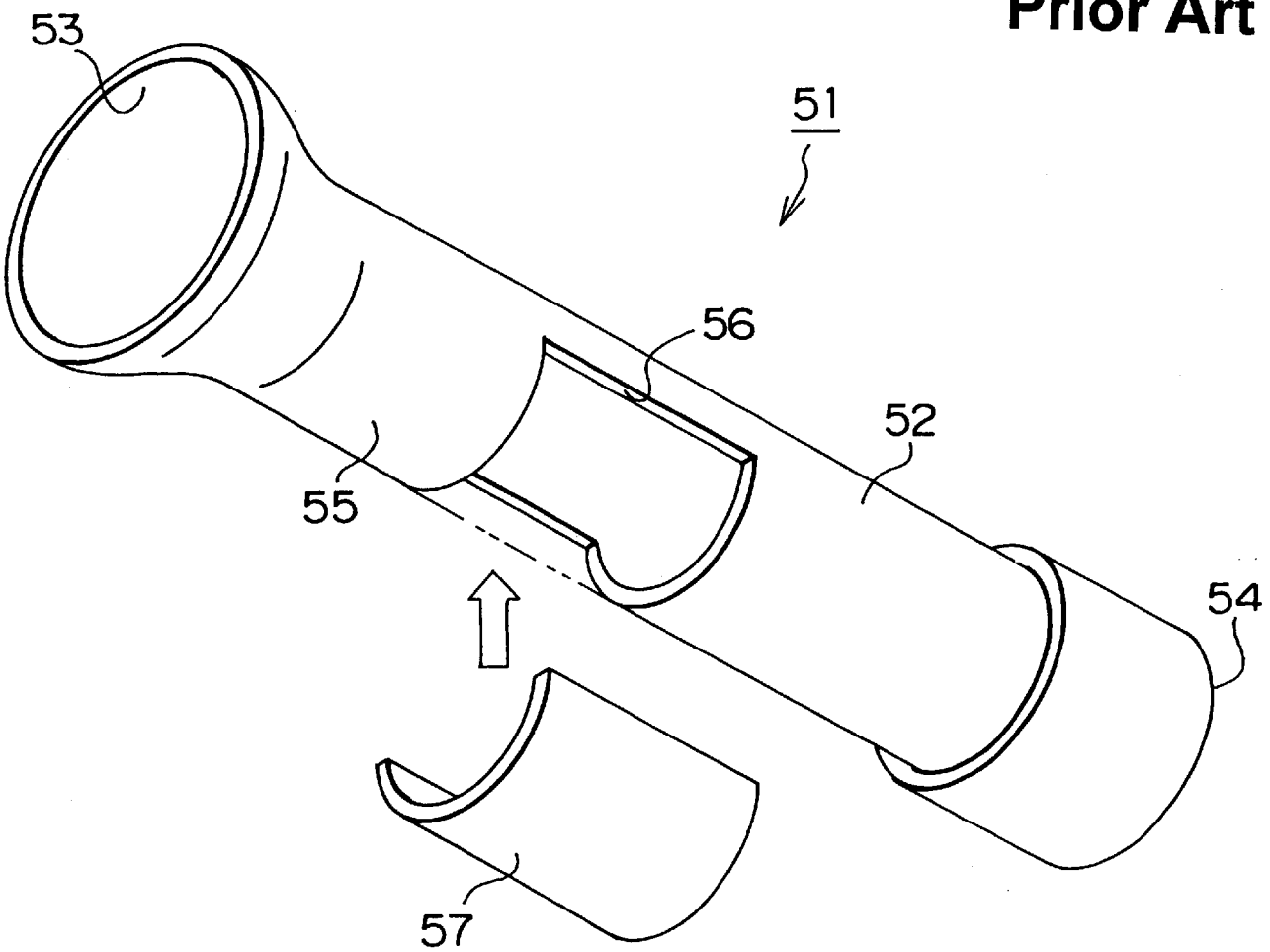
FIG. 6 Prior Art
FIG. 6 is an exploded perspective view showing an example of a conventional intake duct.

As shown in FIGS. 3 to 5, the section of non-woven fabric 14 is formed by laminating two types of polyethylene terephthalate (PET) fibers without weaving them, performing needle punching on the laminated structure, an exploded detail being shown in FIG. 3B, and forming the resulting original non-woven fabric into a flat sheet with a predetermined thickness through hot-press molding. The thus obtained piece of non-woven fabric 14 is trimmed by a trimming die to be formed in to a planar rectangular shape.

The above-identified two types of PET fibers are comprised of regular fibers 26 and binder fibers 27, as shown in FIG. 3B. The regular fibers 26 are high-melting-point fibers as shown in FIG. 4B, and the binder fibers 27 are low-melting-point fibers as shown in FIG. 4A. Each of the regular fibers 26 is constructed with a water-repelling layer 29 made of a water repellent material, such as fluorine-or silicon-based water repellent, formed around a core material 28 of a high-melting-point PET resin as an example of a high-melting-point thermoplastic resin. The melting point of the high-melting-point PET resin constituting the core material 28 is preferably in the range of 220 to 260° C. The outer diameter of the regular fiber 26 is preferably in the range of 10 to 100 $\mu$m, and more preferably, in the range of 30 to 50 $\mu$m. The compounding weight ratio of the regular fibers 26 in the original non-woven fabric is preferably in the range of 50 to 90%, and more preferably, in the range of 65 to 75%.

On the other hand, the binder fiber 27 is constructed with a binder layer 30, made of a low-melting-point PET resin as an example of a low-melting-point thermoplastic resin, formed around a core material 28 similar to that of the regular fiber 26. In the case where the low-melting-point PET resin constituting the binder layer 30 has a crystalline property, the melting point of the PET resin is preferably in the range of 120 to 190° C., and more preferably, in the range of 140 to 170° C. In the case where the PET resin has a non-crystalline property, the melting point thereof is preferably in the range of 100 to 190° C., and more preferably, in the range of 120 to 170° C. Moreover, the binder fiber 27 is formed with a smaller thickness than the regular fiber 26, and the outer diameter of the binder fiber 27 is preferably in the range of 10 to 100 $\mu$m, and more preferably, in the range of 15 to 25 $\mu$m. Moreover, the compounding ratio of the binder fibers 27 in the original non-woven fabric is preferably in the range of 10 to 50%, and more preferably, in the range of 25 to 35%.

As described above, the non-woven fabric 14 is prepared by compressing the original non-woven fabric to a predetermined thickness using a mold heated to about 200° C. by hot-press molding. With the hot-press molding thus performed, the binder layers 30 of the binder fibers 27 contained in the original non-woven fabric are brought into a fused or molten state, and the regular fibers 26 and the binder fibers 27 are fused and bonded together at their contact points. Thus, a three-dimensional network structure formed by needle-punching the original non-woven fabric is fixed within the non-woven fabric 14. In other words, the regular fibers 26 and the binder fibers 27 are three-dimensionally entwined with each other and fixed in this state.

The non-woven fabric 14 is joined and fixed to the peripheral edge 23 of the opening 13 of the duct body 12 by a hot plate welding method which will be described later. However, using the hot plate welding method, the thermoplastic resin forming the peripheral edge 23 around the opening 13 will penetrate into the non-woven fabric 14 by a suitable depth from its surface, and then solidifies in this state. Thus, the penetrating resin is fixed while being three-dimensionally intertwined with the non-woven fabric 14 having the aforementioned three-dimensional network structure.

When the non-woven fabric 14 is joined and fixed to the peripheral edge 23 about the opening 13 by hot plate welding, some of the molten resin from the peripheral edge 23 swells inwards on the non-woven fabric 14 to form a slope-forming portion 31 (see FIG. 2E) at the inner peripheral surface of the peripheral edge 23. Thus, the inner peripheral surface of the circumferential wall 19 of the duct body 12 is smoothly joined with the inner surface of the non-woven fabric 14 shaped like a flat plate.

With the intake duct 11 constructed as described above, outside air is admitted from the intake port 16 and also through the non-woven fabric 14 as the vehicle engine is started and the pressure on the air-cleaner side of the intake duct 11 is reduced. The intake balance between the amount of outside air admitted from the intake port 16 and the amount of outside air admitted through the non-woven fabric 14 is suitably adjusted. This adjustment aims at varying the natural frequency of the intake duct 11 so as to suppress air-columnar resonance in the range of normal use of the vehicle engine and thus reduce the intake noise.

Here, the intake balance between the amount of outside air admitted from the intake port 16 and the amount of outside air admitted through the non-woven fabric 14 is controlled by the air permeability and location of the non-woven fabric 14. The air permeability and location of the non-woven fabric 14 are set as appropriate so as to achieve an effective reduction in intake noise, taking account of the shape and length of the intake duct 11, the capacity of the air cleaner connected to the duct 11, and the displacement of the vehicle engine.

The air permeability of the non-woven fabric 14 depends upon the thickness of the non-woven fabric 14. Where the air passes through the non-woven fabric 14 with a pressure difference of 98 Pa, the volume of the air passing through per cubic meter of the non-woven fabric 14 of this embodiment is preferably in the range of 990 to 2050 $m^3/h$, and more preferably, in the range of 1250 to 2050 $m^3/h$.

In the intake duct 11 as described above, if the above-indicated volume of the air passing through the non-woven fabric 14 is less than 990 $m^3/h$, the amount of outside air admitted through the non-woven fabric 14 is liable to be insufficient. As a result, the above-described intake balance is upset or lost, making it difficult to effectively reduce intake noise. If the above-indicated volume of the air passing through the non-woven fabric 14 exceeds 2050 $m^3/h$, on the other hand, an excessive amount of outside air is admitted through the non-woven fabric 14. As a result, the aforementioned intake balance is upset or lost, making it difficult to effectively reduce intake noise.

Hereinafter, a method of producing the duct body 12 will be described with reference to FIGS. 2A to 2E.

First, the duct body 12 is formed into a substantially hollow cylindrical shape by blow molding. During blow molding, a bag portion 34 that inflates or expands outwards from the flat portion 22 of the rectangular portion 21, and is formed in the axially middle portion 12*b* of the duct body 12, as shown in FIG. 2A. Then, as shown in FIG. 2B, the bag portion 34 is cut away with a cutter 35 at a certain distance spaced away from the flat portion 22 such that the cut surface forms a substantially flat surface. Thus, the opening 13 defined by the peripheral edge 23 project by a certain height from the flat portion 22.

Thereafter, the non-woven fabric 14 is joined and fixed to the peripheral edge 23 by hot plate welding. Hot plate welding is carried out in the following manner.

As shown in FIG. 2C, a hot plate 36, heated to a temperature capable of melting the thermoplastic resin of the duct body 12, is pressed against the distal end face of the peripheral edge 23. Prior to contact between edge 23 and hot plate 36, a fluororesin sheet 37 is interposed between the hot plate 36 and the peripheral edge 23 in order to prevent stringiness upon removing the hot plate 36 from the peripheral edge 23. This step of pressing the peripheral edge 23 against the hot plate 36 causes the distal end of the peripheral edge 23 to be melted due to the heat transferred from the hot plate 36.

Then, as shown in FIG. 2D, the non-woven fabric 14 is pressed against the still melted distal end face of the peripheral edge 23 by means of a pressure jig (not shown) or the like. The non-woven fabric 14 is held in the pressed state until the distal end portion of the peripheral edge 23 is sufficiently cooled, and a part of the thermoplastic resin of the peripheral edge 23 has penetrated into the non-woven fabric 14 and solidified. Thus, the non-woven fabric 14 is joined and fixed to the peripheral edge 23 of the opening 13.

Moreover, by pressing the non-woven fabric 14 part of the melted resin from the peripheral edge 23 swells at its inner peripheral surface, whereby the slope-forming portion 31 is automatically formed. Thus, the inner peripheral surface of the circumferential wall 19 of the duct body 12 is smoothly joined with the inner surface of the non-woven fabric 14.

According to the present embodiment, the following effects can be obtained.

(1) In the above-described intake duct 11, the opening 13 is formed in a part of the circumferential wall 19 of the duct body 12 so that the distal end of the peripheral edge 23 of the opening 13 forms a flat surface. The non-woven fabric 14, shaped like a flat plate, is joined and fixed to the duct body 12 so as to cover the opening 13. Here, a part of the thermoplastic resin from the peripheral edge 23 will have penetrated into the non-woven fabric 14 and solidified therein.

With the above arrangement, it is no longer necessary to form the non-woven fabric 14 with a curved surface corresponding to that of the circumferential wall 19 of the duct body 12, and therefore the structure of a mold for forming the non-woven fabric 14 can be significantly simplified. Also, there is no need to prepare respective molds for the intake duct 11 and the non-woven fabric 14, for each type of intake duct 11 to be manufactured. Accordingly, the manufacturing cost of the intake duct 11 can be significantly reduced.

Moreover, the non-woven fabric 14 is joined and fixed to the peripheral edge 23 of the opening 13 by having a portion of the thermoplastic resin of the peripheral edge 23 penetrate into the non-woven fabric 14. This makes it possible to prevent a gap or clearance from being formed between the circumferential wall 19 of the duct body 12 and the non-woven fabric 14, without accurately forming the non-woven fabric 14 or inserting a separate sealing material between the duct body 12 and the non-woven fabric 14. Thus, in the intake duct 11, the intake balance between the amount of outside air admitted through the non-woven fabric 14 and the amount of outside air admitted without passing through the non-woven fabric 14 is held within a predetermined range, thus achieving a significant reduction in intake noise during normal operation of the vehicle engine. Moreover, since highly accurate formation of the non-woven fabric 14 and a separate sealing material are not needed, the manufacturing cost of the intake duct 11 can be further reduced.

As described above, a part of the circumferential wall 19 of the duct body 12 is formed from an air-permeable porous non-woven fabric 14, and the intake duct 11 having an enhanced capability of reducing the intake noise can be manufactured at reduced cost.

(2) In the above-described intake duct 11, the peripheral edge 23 of the opening 13 is formed so as to project outwardly from the flat portion 22 surrounding the opening 13.

Therefore, upon melting the peripheral edge 23 of the opening 13 by a hot plate 36 before joining and fixing the non-woven fabric 14 to the edge 23, the hot plate 36 can be prevented from contacting the circumferential wall 19 including the flat portion 22 of the duct body 12.

Accordingly, the heating effect on the circumferential wall 19, other than at the peripheral edge 23 of the opening 13, is reduced and incidental deformation of the circumferential wall 19 can be suppressed.

(3) In the above-described intake duct 11, the slope-forming portion 31 for smoothly joining the inner wall surface of the circumferential wall 19 with the inner surface of the non-woven fabric 14 is formed at the inner surface of the peripheral edge 23 of the opening 13.

Thus, even though part of the circumferential wall 19 forms a flat surface for joining the non-woven fabric 14 in the form of a flat plate, an otherwise possible increase in intake pressure loss within the intake duct 11 can be suppressed or prevented. This ensures smooth flow of the incoming outside air through the intake duct 11.

(4) In the above-described intake duct 11, the non-woven fabric 14 is formed from high-melting-point regular fibers 26 and low-melting-point binder fibers 27. Both types of fibers 26, 27 are fused and bonded together at their contact points by hot-press molding.

Accordingly, a three-dimensional network structure formed by needle-punching the original non-woven fabric prior to the hot-press molding is fixed in the non-woven fabric 14. Then, the non-woven fabric 14, having the three-dimensional network structure, is joined and fixed to the peripheral edge 23 of the opening 13 such that a part of the thermoplastic resin of the peripheral edge 23 penetrates into the non-woven fabric 14 to be intertwined with the fibers of the non-woven fabric 14. Accordingly, the non-woven fabric 14 can be firmly joined and fixed to the duct body 12.

(5) In the above-described non-woven fabric 14, a water-repelling layer 29 is formed on the surface of the regular fibers 26.

Therefore, the non-woven fabric 14 is provided with a water-repelling property whereby water, dust, and the like, can be prevented from entering the inside of the non-woven fabric 14. Thus, the non-woven fabric 14 becomes less susceptible to clogging. In addition, the intake balance in the intake duct 11 between the amount of outside air admitted from the intake port 16 and the amount of outside air admitted through the non-woven fabric 14 is held in a suitable range for an extended period of time. Accordingly, the intake duct 11 is able to maintain an effect of reducing intake noise for a prolonged time.

(6) The aforementioned non-woven fabric 14 is shaped into a flat plate or sheet as a result of hot-press molding performed on the original non-woven fabric.

Therefore, the piece of non-woven fabric 14 having a desired thickness can be easily formed from the original non-woven fabric. Moreover, even after removing the pressure and taking the piece of non-woven fabric 14 out of the mold in the press molding, the shaped non-woven fabric 14 does not incidentally swell due to elasticity of the fibers 26, 27 that constitute the piece of non-woven fabric 14. Accordingly, the piece of non-woven fabric 14 can maintain a predetermined thickness, and the air permeability thereof can be easily controlled.

Moreover, when the shaped piece of non-woven fabric 14 is trimmed in accordance with the shape of the opening 13, the piece of non-woven fabric 14 retains its hardness, and is prevented from being torn off from a trimming die, thus assuring smoothness of its cut surfaces. This leads to good appearances of the piece of non-woven fabric 14 and the intake duct 11.

(7) In producing the above-described intake duct 11, the opening 13 is first formed in a part of the circumferential wall 19 of the duct body 12 having a hollow cylindrical shape. Then, the peripheral edge 23 of the opening 13 is melted, and the piece of non-woven fabric 14, shaped like a flat plate or sheet, is pressed against the melted peripheral edge 23 to be bonded thereto.

By pressing the piece of non-woven fabric 14 against the melted peripheral edge 23 of the opening 13 part of the melted thermoplastic resin of the peripheral edge 23 easily penetrates into the non-woven fabric 14. Moreover, since only the peripheral edge 23 of the opening 13, rather than the entire duct body 12, needs to be heated, deformation of the duct body 12 can be suppressed. Further, by pressing the piece of non-woven fabric 14 against the peripheral edge 23 which is in the molten state, the thermoplastic resin automatically swells or expands to form the slope-forming portion 31 on the inner surface of the peripheral edge 23. Thus, the inner wall surface of the circumferential wall 19 of the duct body 12 is smoothly joined with the inner surface of the piece of non-woven fabric 14 in the form of a flat plate or sheet.

With the intake duct 11 produced in the above manner, the aforementioned effects (1) and (2) can be realized with a simple structure.

(8) In producing the aforementioned intake duct 11, a part of the circumferential wall 19 of the duct body 12 is expanded or inflated to form a bag portion 34 which is cut at a certain distance away from the surrounding flat portion 22 thereby forming the opening 13.

Therefore, the peripheral edge 23 of the opening 13 having a flat end face can be easily formed so as to project from the surrounding flat portion 22. Thus, the aforementioned effect (2) can be realized with a simple structure.

(9) Each of the binder fibers 27 of the aforementioned non-woven fabric 14 is constructed such that the high-melting-point core material 28 is covered with the low-melting-point binder layer 30.

During hot-press molding of the original non-woven fabric, therefore, the temperature of the mold is set to a level that is equal to or higher than the melting point of the binder layer 30 but does not exceed the melting point of the core material 28, so that only the binder layer 30 can be melted. Thus, the binder fibers 27 are not entirely melted, and the three-dimensional network structure formed by needle punching prior to the hot-press molding can be retained and fixed in the piece of non-woven fabric 14.

(10) In the aforementioned intake duct 11, the opening 13 of the duct body 12 and the piece of non-woven fabric 14 are each formed into a substantially flat rectangular shape.

Therefore, the non-woven fabric 14 can be commonly used for other intake ducts having different shapes. Moreover, the non-woven fabric 14 involves a reduced trimming portion, thus assuring an improved yield of pieces of non-woven fabric. Consequently, the manufacturing cost of the intake duct 11 can be further reduced.

While one preferred embodiment of the invention has been described above, for illustrative purpose only, it is to be understood that the invention may be otherwise embodied with various changes, modifications or improvements that would occur to those skilled in the art.

In the illustrated embodiment, the duct body 12 may be formed from, e.g., a thermoplastic resin loaded with an inorganic or organic filler, such as glass fiber, carbon fiber, metal fiber, various types of whisker, or asbestos.

While the intake duct 11 has a substantially hollow cylindrical shape in the illustrated embodiment, the intake duct 11 may be formed into other shapes as desired. For example, the intake duct 11 may be formed into an oval or elliptical shape in cross section, or the duct body 12 may be a bent pipe. As another example, the opposite ends 12*a* of the duct body 12 may have different shapes in cross section. In short, the shape of the intake duct 11 may be selected as desired provided that the opening 13 has a peripheral edge 23 with a flat end face and is formed in a portion of the circumferential wall 19 of the duct body 12, and the piece of non-woven fabric 14 is joined and fixed to the peripheral edge 23 so as to cover the opening 13. With this arrangement, the intake duct 11 with an increased capability of reducing the intake noise can be manufactured at relatively low cost.

While the peripheral edge 23 of the opening 13 is melted by heat transfer from the hot plate 36 in the illustrated embodiment, the peripheral edge 23 may be melted by heat generated due to, e.g., vibration transmitted from a vibrator, ultrasonic waves transmitted from an ultrasonic generating apparatus, or high-frequency waves transmitted from a high-frequency generating apparatus.

In the illustrated embodiment, the peripheral edge 23 of the opening 13 is melted in advance, and subsequently the piece of non-woven fabric 14 is pressed against the melted peripheral edge 23 to be joined and fixed to the duct body 12. However, the piece of non-woven fabric 14 may be heated and at the same time pressed against the peripheral edge 23 of the opening 13 so that thermoplastic resin from the peripheral edge 23 penetrates into the piece of non-woven fabric 14.

While the water-repelling layer 29 is formed only at the surface of the regular fiber 26 in the illustrated embodiment, such a water-repelling layer may also be provided on the surface of the binder fiber 27. Also, a binder layer similar to the binder layer 30 may be formed at the surface of the regular fiber 26.

In the illustrated embodiment, the piece of non-woven fabric 14 is composed of the regular fibers 26 and the binder fibers 27 both formed from PET resin. It is, however, possible to employ a non-woven fabric article formed by press molding from an original non-woven fabric consisting of fibers of other type of thermoplastic resin, such as PP, PE or PA, or a sponge-like material, felt, asbestos sheet or glass wool.

Although the present invention is applied to an intake duct for a vehicle engine in the illustrated embodiment, the invention may be further applied to an intake duct for another type of internal combustion engine, such as a marine engine, an aircraft engine, or a generator engine.

What is claimed is:

1. An intake duct adapted to introduce outside air into an air cleaner of an internal combustion engine, comprising:

a hollow duct body including a circumferential wall comprising a resin, said duct body having an opening formed in a substantially flat portion of the circumferential wall to provide an end face that lies in a substantially flat plane; and a non-woven fabric which is joined to an outer surface of the duct body so as to cover the opening, said non-woven fabric being fixed to the duct body by causing resin from the duct body to penetrate into the non-woven fabric.

2. An intake duct according to claim 1, wherein the circumferential wall of the duct body includes a peripheral edge that defines the opening, said peripheral edge projecting outwardly from a portion of the circumferential wall that surrounds the opening.

3. An intake duct according to claim 2, wherein the peripheral edge of the opening includes a slope-forming portion formed on an inner surface thereof, said slope-forming portion smoothly joining an inner wall surface of the duct body with an inner surface of the non-woven fabric.

4. An intake duct according to claim 1, wherein the non-woven fabric comprises high-melting-point fibers formed principally of a high-melting-point thermoplastic resin, and low-melting-point fibers formed principally of a low-melting-point thermoplastic resin and having a lower melting point than said high-melting-point fibers, said high-melting-point fibers and said low-melting-point fibers being bonded together at contact points thereof.

5. An intake duct according to claim 4, wherein at least one of the high-melting-point fiber and the low-melting-point fiber includes a water repelling layer formed on a surface thereof.

6. An intake duct according to claim 1, wherein the non-woven fabric is formed in a generally flat shape by hot-press molding.

7. A method of producing an intake duct adapted to introduce outside air into an air cleaner of an internal combustion engine, comprising:

providing a hollow duct body including a circumferential wall comprising a resin, said duct body having an opening formed in a substantially flat portion of the circumferenitial wall to provide an end face that lies in a substantially fat plane; and providing a non-woven fabric which is joined to an outer surface of the duct body so as to cover the opening, said non-woven fabric being fixed to the duct body by causing resin from the duct body to penetrate into the non-woven fabric.

8. A method according to claim 7, wherein said forming an opening comprises:

expanding a first portion of the circumferential wall of the duct body to form a bag portion; and cutting the bag portion along a plane at a point spaced from a second portion of the circumferential wall that surrounds the bag portion, such that a projection is formed as part of the circumferential wall to provide the peripheral edge of the opening.

9. A method according to claim 7, wherein the non-woven fabric article is formed in a generally flat shape by hot-press molding performed on an original non-woven fabric.

* * * * *